US006287192B1

(12) United States Patent
Kim et al.

(10) Patent No.: US 6,287,192 B1
(45) Date of Patent: Sep. 11, 2001

(54) SLURRY SUPPLY SYSTEM FOR CHEMICAL MECHANICAL POLISHING PROCESS HAVING SONIC WAVE GENERATOR

(75) Inventors: Sue-ryeon Kim, Suwon; Sueng-uhn Kim, Yongin; Jae-kang Jeon, Anyang; Sa-moon Hong, Suwon, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/326,655

(22) Filed: Jun. 7, 1999

(30) Foreign Application Priority Data

Jun. 23, 1998 (KR) ..... 98-23772

(51) Int. Cl.[7] ..... B24B 7/19
(52) U.S. Cl. ..... 457/60; 457/56; 457/446
(58) Field of Search ..... 451/36, 60, 446, 451/28, 447, 910, 165, 99–100, 56, 271; 125/21, 16.02; 366/111–114, 116, 127; 134/2, 25, 4, 26, 30, 31, 37, 902; 204/157.15, 157.42; 205/742, 748, 770, 755, 756

(56) References Cited

U.S. PATENT DOCUMENTS 3,162,986 * 12/1964 Oliveri ..... 451/446
3,226,092 * 12/1965 Graham et al. ..... 336/111
3,500,591 * 3/1970 Gawronski et al. ..... 451/446
4,242,841 * 1/1981 Ushakov et al. ..... 451/116
4,513,894 * 4/1985 Doyle et al. ..... 451/446
5,201,305 * 4/1993 Takeuchi ..... 125/21
5,741,173 * 4/1998 Lundt et al. ..... 451/56
5,799,643 * 9/1998 Miyata et al. ..... 125/21
6,006,738 * 12/1999 Itoh et al. ..... 125/21
6,053,802 * 4/2000 Yi et al. ..... 451/60

* cited by examiner

*Primary Examiner*—Joseph J. Hail, III
*Assistant Examiner*—George Nguyen
(74) *Attorney, Agent, or Firm*—Jones Volentine, PLLC

(57) ABSTRACT

A system for supplying slurry to a processing facility, includes a tank containing the slurry, and slurry supply piping connected to the tank to allow the slurry to flow from the tank to the processing facility. A sonic wave generator is disposed along the slurry supply piping, such that sonic waves are propagated through the slurry. The sonic waves prevent the clustering of small primary abrasive particles into larger secondary abrasive particles, or break apart any clustered secondary particles, which may cause fine scratches on the surface of a wafer during a polishing operation.

16 Claims, 3 Drawing Sheets

SLURRY SUPPLY SYSTEM FOR CHEMICAL MECHANICAL POLISHING PROCESS HAVING SONIC WAVE GENERATOR

BACKGROUND OF THE INVENTION

1. Field of the Invention

The present invention relates to a slurry supply system for a Chemical Mechanical Polishing (CMP) process used in manufacturing semiconductor devices, and more particularly, to a slurry supply system for supplying the slurry to the CMP process facility in a state where the slurry is devoid of clustered primary abrasive particles, using a sound wave generating device to break apart the secondary abrasive particles.

2. Description of the Related Art

As semiconductor devices become more highly integrated, more sophisticated patterns, and advanced techniques for forming such patterns, are required. Present semiconductor devices are layered structures comprised of multiple insulating and conductive layers, with complex patterns being formed thereon to achieve the required circuit distribution.

However, the surface topology of the semiconductor device layers is becoming more complicated, and the step-height difference between layers can cause malfunctions in subsequent fabrication process steps. In addition, the aspect ratio of contact holes formed in the layers is increasing, which also causes fabrication and processing difficulties.

Among the various fabrication processes, photolithography is used to form a photoresist pattern on a semiconductor substrate. The photolithography process involves: coating a wafer with photoresist; aligning a pattern mask on the wafer, where the pattern mask has a specific circuit pattern formed thereon; exposing the photoresist on the wafer by irradiating light through the pattern mask; and developing the photoresist to form the photoresist pattern.

In early semiconductor devices, the critical dimension for feature resolution was relatively wide and the device itself was comprised of only a few layers. Accordingly, the photolithography process did not cause many problems. However, in present devices, the critical dimension is much narrower and the devices have numerous layers, which makes it increasingly difficult to achieve precise exposure focus between the upper and lower layers of the step-height differences among the layers. Therefore, it becomes more difficult to form a photoresist pattern having a precise critical dimension and vertical profile.

Accordingly, there is a great demand for improved wafer planarization techniques that address the processing problems caused by the increased aspect ratio and the step-height differences of the present semiconductor devices.

Planarization techniques to decrease the step-height difference include deposition of a spin-on-glass (SOG) layer, etch back methods, reflow methods, and global planarization methods.

Global planarization methods are performed along the whole surface of the wafer, and one such technique, Chemical Mechanical Polishing (CMP), planarizes the surface of the wafer through combined chemical and physical mechanisms.

During a CMP process, slurry is supplied between the wafer surface having circuits pattern formed thereon and the surface polishing pad confronting the wafer surface. While the slurry and the wafer surface are reacting chemically, the wafer and the polishing pad rotate in different directions relative to each other, such that protrusions or projections along the wafer surface are polished and the surface of the wafer is planarized.

The removal rate and uniformity are important factors in the CMP process, and these factors depend on several considerations including the CMP facility process conditions, the types of slurries employed, and the types of polishing pads that are used. In particular, the slurry composition, its pH, and the ion concentration, have a great impact on the resulting chemical reaction with the thin film being planarized.

Slurry compositions are generally of two types: oxide film slurry and metal film slurry. The oxide film slurry is alkali, and the metal film slurry is acidic.

For example, when silicon dioxide ($SiO_2$) is planarized using an oxide film CMP process, the reaction with the alkali slurry causes the silicon dioxide ($SiO_2$) to become hydrophillic, such that is readily absorbs water. The water induced into the silicon dioxide ($SiO_2$) disconnects the bonds between the silicon dioxide ($SiO_2$) atoms, and the silicon dioxide ($SiO_2$) is then removed by the physical mechanism (friction) between the rotating pad and wafer, together with an abrasive.

On the other hand, when a metal layer is planarized using a metal film CMP process, a chemical reaction on the surface of the metal film caused by an oxidant inside the slurry creates a metal oxide film. The metal oxide film is then removed by the physical mechanism (friction) between the rotating pad and wafer, together with an abrasive.

More specifically, the metal film slurry comprises an oxidizing agent, an abrasive, deionized water, and acid. The abrasives in the slurry are composed of so-called primary abrasive particles, having a diameter ranging from about 130 nm to about 170 nm.

The conventional slurry supply system is constructed such that the slurry is continuously circulated through a line connected to a slurry tank in order to prevent the slurry from stagnating and thereafter deteriorating inside the slurry tank. While the slurry is circulating, some of the slurry is tapped off and discharged by means of a pump, and supplied to a pad table of the CMP process facility.

FIG. 1 shows a conventional slurry supply system of the CMP process for manufacturing semiconductor devices. Generally, the system supplies a slurry 2 stored inside a slurry tank 1 to the CMP facility through a slurry supply line 4. The slurry 2 inside the slurry tank 1 is pumped out of the slurry tank 1 using a pump (not shown), is circulated through a slurry discharge line 3*a* and a slurry recirculation line 3*b*, before reentering the slurry tank 1. At a point along the slurry discharge line 3*a* and the slurry recirculation line 3*b*, there is connected a slurry supply line 4 and a pump 5 along the slurry supply line 4 for tapping off some of the slurry 2. The slurry 2 is then provided to the pad table 6 of the CMP facility via a nozzle 7, so that the planarization process for the wafer 8 secured by a wafer holder 34 can be easily performed.

However, sometimes the abrasives contained in the slurry undesirably cluster in such a manner as shown in FIG. 2. More specifically, the abrasives in the slurry should preferably exist in the state of the sole primary abrasive particles 9, but despite the continuous circulation of the slurry 2, some of the primary abrasive particles 9 tend to cluster chemically or physically to thereby form larger so-called secondary abrasive particles 10. The secondary abrasive particles 10 may have diameters of 330 nm to 570 nm or more, as compared to diameters of 130 nm to 170 nm for the primary abrasive particles 9. These primary abrasive particles 9 and secondary abrasive particles 10 remain mixed in the slurry 2 and are supplied to the pad table 6. The larger secondary abrasive particles 10 may cause fine scratches on the wafer surface during the CMP process.

Such fine scratches on the wafer surface can thereafter induce non-uniform deposition of layers during the photoresist coating process or Chemical Vapor Deposition (CVD) process, thereby producing cut-line defects in the metal layers.

Prior methods to prevent abrasive particle clustering have included minimizing the particle size of the abrasive, adding chemicals such as a surface-active agent, or preventing the congestion and dryness of the supplied slurry. However, the generation of the secondary abrasive particles has not been completely prevented due to the various chemical characteristics of the components of the slurry, and so, there fine scratches on the wafer surface still present a significant processing problem.

SUMMARY OF THE INVENTION

The present invention is directed to a slurry supply system for a Chemical Mechanical polishing (CMP) process for manufacturing semiconductor devices that prevents the generation of fine scratches on the wafer surface, thereby improving the production yield of wafers in a subsequent process.

To achieve these and other advantages and in accordance with the purpose of the present invention, as embodied and broadly described, the slurry supply system includes a tank containing the slurry. Slurry supply piping connected to the tank allows the slurry to flow from the tank to the processing facility. A sonic wave generator is disposed along the slurry supply piping, such that sonic waves are propagated through the slurry. The sonic waves prevent the clustering of small primary abrasive particles into larger secondary abrasive particles, or break apart any clustered secondary particles, which prevents fine scratches from being formed on the surface of a wafer during a polishing operation.

The sonic wave generator may be disposed in a secondary tank containing slurry that is provided between the tank and the processing facility. Alternatively, the sonic wave generator may surround a circumferential surface of a portion of the slurry supply piping just upstream of the processing facility. In still another alternate embodiment, two sonic wave generators may be provided, one in the secondary tank and one surrounding the circumferential surface of a portion of the slurry supply piping just upstream of the processing facility.

Sonic waves generated at one or more frequencies may be utilized, for example, ultrasonic frequencies of about 10 kHz to about 100 kHz, or, megasonic frequencies of about 700 kHz to about 1000 kHz, and various other frequency ranges.

In any of the embodiments of the present invention, the sonic waves prevent the clustering of small primary abrasive particles into larger secondary abrasive particles, or break apart any clustered secondary particles, which may cause fine scratches on the surface of a wafer during a polishing operation.

It is to be understood that both the foregoing general description and the following detailed description are exemplary and explanatory and are intended to provide further explanation of the invention as claimed.

BRIEF DESCRIPTION OF THE DRAWINGS

Further objects, features and advantages of the present invention will become apparent from the following detailed description of preferred embodiments thereof made with reference to the accompanying drawings, in which.

DETAILED DESCRIPTION OF THE PREFERRED EMBODIMENTS

Preferred embodiments of the present invention will now be described in detail with reference to the accompanying drawings.

The slurry supply system according to the present invention is designed to break apart the clustered secondary abrasive particles and return them to their original sole primary abrasive particle state, using sonic wave energy produced by a sonic wave generator.

Figure 1:
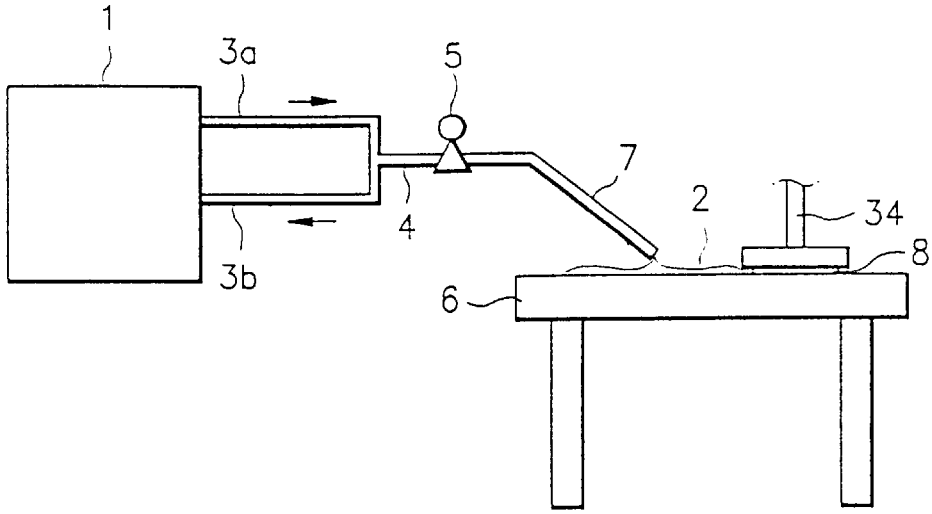
FIG. 1 (PRIOR ART)
FIG. 1 is a schematic diagram of a conventional slurry supply system for a Chemical Mechanical Polishing (CMP) process.
Figure 2:
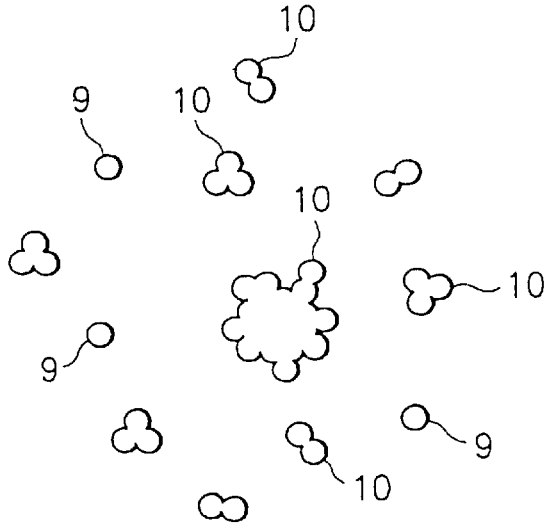
FIG. 2 (PRIOR ART)
FIG. 2 shows the distribution of sole primary abrasive particles and clustered secondary abrasive particles in a slurry supplied by the conventional slurry supply system.
Figure 3:
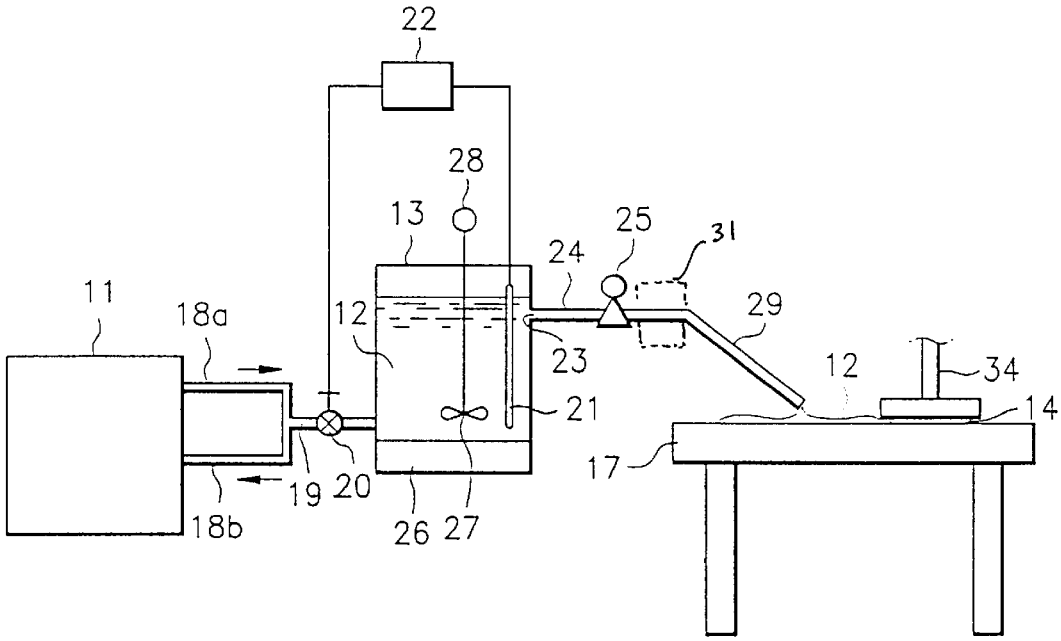
FIG. 3 is a schematic diagram of a slurry supply system for a CMP process according to an embodiment of the present invention.

In general, referring to FIG. 3, the slurry supply system for a Chemical Mechanical Polishing (CMP) process according to an embodiment of the present invention supplies a slurry 12 from inside a slurry tank 11 to a CMP process facility through a slurry supply piping configuration. More specifically, the slurry 12 in the slurry tank 11 is continuously circulated through a slurry discharge line 18*a* and a slurry recirculation line 18*b*. At a point along the slurry discharge line 18*a* and the slurry recirculation line 18*b*, there is connected a slurry supply line 19, which in turn is connected to a secondary tank 13 so as to supply a certain amount of slurry 12 into the secondary tank 13.

Within the secondary tank 13 there is disposed a sonic wave generator 26 that propagates sonic waves through the slurry 12, and a mixer 27 connected to a motor 28 for stirring and mixing the slurry 12 inside the secondary tank 13.

A valve 20 is disposed along the slurry supply line 19 for controlling the amount of slurry 12 supplied into the secondary tank 13. A level sensor 21 arranged in the secondary tank 13 senses the height of the slurry 12 level supplied therein. A controller 22 is electrically connected to the level sensor 21 and the valve 20, and serves to control the opening/closing of the valve 20 based on the signal from the level sensor 21. Accordingly, the level of the slurry 12 inside the secondary tank 13 remains nearly constant.

Note that the slurry supply line 19 is connected to a lower portion of the secondary tank 13, and just above the sonic waver generator 26, which is also disposed at the lower portion of the secondary tank 13. This is because heavy residues of the slurry 12 will settle near the bottom of the secondary tank 13. In order to ensure that only slurry 12 without such heavy residues is provided to a pad table 17 of a CMP facility, an outlet 23 is formed in the wall of the secondary tank 13, at a location proximate to but below the upper portion of the slurry level inside the secondary tank 13. A slurry outlet line 24 provides the flow path between the outlet 23 and the pad table 17 of the CMP facility. While the slurry 12 may be sent to the pad table 17 via a gravity feed through the slurry outlet line 24 and nozzle 29, it is preferable to provide a pump 25 on the slurry outlet line 24 to control the flow amount of the slurry 12 supplied to the pad table 17.

After the slurry 12 is provided to the pad table 17 of the CMP facility via the nozzle 29, the planarization process for the wafer 14 secured by wafer holder 34 commences.

Figure 5:
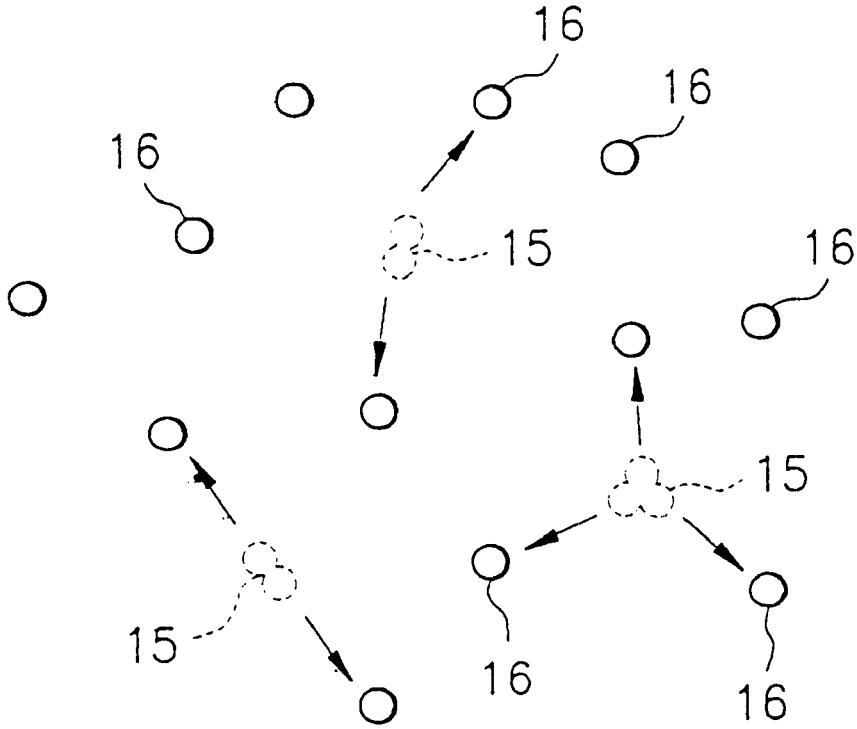
FIG. 5 shows the distribution of abrasive particles in a slurry supplied by the slurry supply system of the present invention.

The procedure for separating the clustered secondary abrasive particles and returning them to their original sole primary abrasive particle state will now be described in greater detail. The ultimate result, as shown in FIG. 5, depicts the secondary abrasive particles 15 being separated into primary abrasive particles 16.

First, the sonic wave generator 26 propagates the oscillating sonic waves through the slurry 12 inside the secondary tank 13. The sonic wave generator 26 generally comprises a sonic wave oscillator for generating sonic waves, and a sonic wave transfer component for transferring the sonic waves from the sonic wave oscillator through the slurry 12.

Any suitable sonic wave generating device may be utilized. The structure and the mechanism of such sonic wave generators are well-known to those skilled in the art and commercially available, so a detailed description thereof is omitted.

Sonic waves generated at one or more frequencies may be utilized, for example, ultrasonic frequencies of about 10 kHz to about 100 kHz, or, megasonic frequencies of about 700 kHz to about 1000 kHz, and various other frequency ranges. The sonic waves serve to break apart many of the secondary abrasive particles 15 of the slurry 12. However, because the strength of the sonic waves dissipate as they propagate through the slurry 12, certain portions of the slurry 12 experience strong vibrations while other portions experience weak vibrations.

To alleviate this problem the mixer 27, with a rotating blade driven by the motor 28, is provided inside the secondary tank 13 in order to mix or stir slurry 12 so that it does not become stagnant. Any suitable mixing device may be employed in the present invention. The mixer 27 prevents the slurry 12 inside the secondary tank 13 from becoming stagnant and facilitates the uniform transferring of the sonic waves throughout the slurry 12. The mixing and sonic wave generating functions can occur simultaneously or sequentially.

Accordingly, the larger clustered secondary abrasive particles 15 in the slurry 12 are broken into the smaller primary abrasive particles 16 before being supplied to the pad table 17. Therefore, the cause of the fine scratches on the wafer surface is eliminated so as to allow a precise CMP process to be carried out, thereby greatly improving the production yield of the wafers.

Preferably, the length of the slurry outlet line 24 from the secondary tank 13 to the nozzle 29 is kept as short as possible, to prevent the primary abrasive particles 16 in the slurry outlet line 24 from re-clustering to form secondary abrasive particles 15 again.

Figure 4:
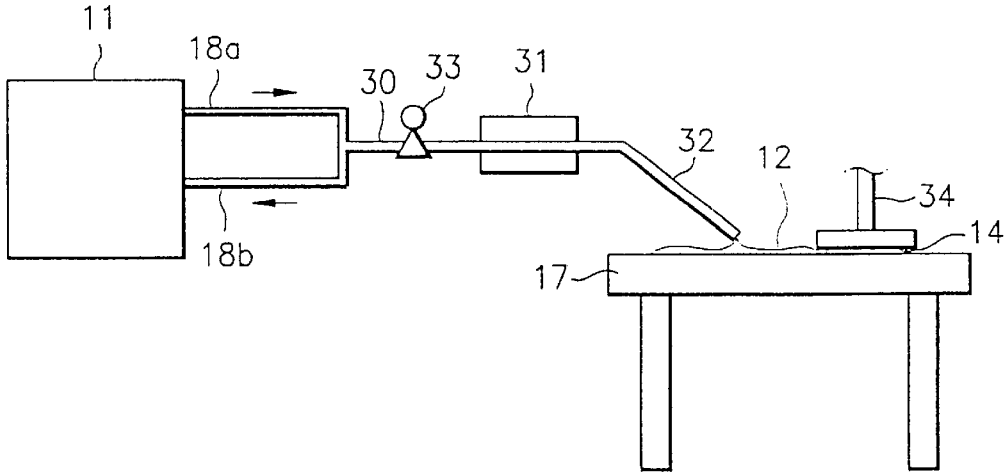
FIG. 4 is a schematic diagram of a slurry supply system for a CMP process according to another embodiment of the present invention.

FIG. 4 schematically shows a slurry supply system for a CMP process according to a second embodiment of the present invention. The same reference numerals in FIG. 4 refer to the same or like elements in FIG. 3, and accordingly, a detailed discussion is omitted as redundant.

Generally, the secondary tank 13, sonic waver generator 26, mixer 27 and associated control and sensing devices in the FIG. 3 embodiment are replaced by a sonic wave oscillator 31 disposed along a slurry supply line 30 in the FIG. 4 embodiment. The sonic wave oscillator 31 applies the sonic waves to the slurry 12 inside the slurry supply line 30.

As in the first embodiment, the slurry 12 in the slurry tank 11 is continuously circulated through a slurry discharge line 18*a* and a slurry recirculation line 18*b*, with the slurry supply line 30 branching off the slurry discharge line 18*a* and the slurry recirculation line 18*b*, to supply the slurry 12 to the pad table 17 using a pump 33 disposed along the slurry supply line 30.

The sonic wave oscillator 31 comprises a tubular sonic wave transfer component surrounding the circumferential surface of the slurry supply line 30 near a nozzle 32, just upstream of the pad table 17. As with the sonic wave generator 26, the sonic wave oscillator 31 can generate various sonic frequency ranges.

In this embodiment therefore, the slurry 12 is moving, i.e., is being supplied through the slurry supply line 30 onto the pad table 17, and the sonic wave energy is applied to the slurry 12 so that the secondary abrasive particles 15 are separated into primary abrasive particles 16 just before the slurry 12 is supplied onto the pad table 17 through the nozzle 32. As such, there is no time for the primary abrasive particles 16 to re-cluster to form secondary abrasive particles 15 again. Therefore, only primary abrasive particles 16 are supplied onto the pad table 17, thereby preventing any possibility of fine scratches being formed on the surface of the wafer 14 due to the secondary abrasive particles 16.

If desired, the sonic wave oscillator 31 of FIG. 4 may be provided on the slurry outlet line 24 in FIG. 3 (phantom lines) just upstream of the nozzle 29, especially when the slurry outlet line 24 is quite long. In this way, any re-clustering of the abrasive particles 15 caused by the length of the secondary slurry outline 24 can be prevented by the sonic wave oscillator 31.

In summary, the present invention prevents fine scratches from being formed on the wafer surface such that the production yield of wafers can be greatly improved. Also, the sonic waves can be transferred to the slurry 12 while it is stored in the secondary tank 13, or moving through the final portion of the slurry supply piping before being supplied to the CMP process facility, or both.

While the present invention has been described in detail, it should be understood that various changes, substitutions and alterations can be made hereto without departing from the spirit and scope of the invention as defined by the appended claims.

What is claimed is:

1. A system for supplying slurry to a processing facility, the system comprising:

a primary tank containing slurry;

slurry supply piping connected to the tank, through which slurry flows to the processing facility;

a sonic wave generator;

a secondary tank containing slurry, the secondary tank being disposed in-line with said slurry supply piping between said primary tank and the processing facility; and a level maintaining system that maintains the slurry in said secondary tank at a predetermined level;

wherein the sonic wave generator is disposed in a lower portion of the secondary tank and is oriented therein to propagate ultrasonic waves through the slurry in the secondary tank, and the secondary tank comprises a tank body, an inlet defined at a lower portion of the tank body and above the sonic wave generator, said slurry supply piping connecting said primary tank to said secondary tank via said inlet, and an outlet defined at an upper portion of the tank body and below said predetermined level of slurry maintained in the secondary tank by said slurry level maintaining system, said slurry supply piping being connected to said outlet such that slurry proximate the upper portion of the secondary tank is fed to the processing facility via said outlet.

2. The system of claim 1, further comprising recirculation piping disposed between the tank and the slurry supply piping, wherein the slurry within the tank is recirculated through the recirculation piping, and a portion of the circulated slurry is supplied into the slurry supply piping.

3. The system of claim 2, further comprising a pump installed along the slurry supply piping for transferring the slurry from the tank to the processing facility.

4. The system of claim 2, wherein the slurry supply piping comprises a first section connecting the recirculation piping to the inlet of the secondary tank, and a second section connected to the outlet of the secondary tank.

5. The system of claim 4, further comprising a valve installed along the first section of piping.

6. The system of claim 1, wherein the slurry level maintaining system comprises:

a valve installed along the slurry supply piping connecting said primary tank to said secondary tank, a level sensor provided within the tank body of said secondary tank for sensing the level of the slurry therein; and a controller connected to the level sensor and the valve, the controller receiving a signal from the level sensor indicative of the level of slurry in the secondary tank and outputting a valve control signal, wherein the valve is opened or closed in response to the valve control signal to maintain a constant amount of slurry in the secondary tank.

7. The system of claim 6, further comprising a mixer disposed within the slurry in the secondary tank for mixing the slurry therein.

8. The system of claim 7, wherein the mixer comprises a rotating blade driven by a motor.

9. The system of claim 7, wherein the sonic wave generator generates a frequency of 10 kHz to 100 kHz.

10. The system of claim 7, wherein the sonic wave generator generates a frequency of 700 kHz to 1000 kHz.

11. The system of claim 7, further comprising another sonic wave generator, said another sonic wave generator surrounding a circumferential surface of a portion of the slurry supply piping connected to the outlet of said secondary tank, wherein sonic waves are propagated through the slurry passing through the piping on its way to the processing facility.

12. A system for supplying slurry to a processing facility, the system comprising:

a tank containing slurry comprising abrasive particles tending to cluster;

slurry supply piping connected to the tank, through which slurry flows to the processing facility; and a sonic wave generator surrounding a circumferential surface of a portion of the slurry supply piping just upstream of the processing facility, said sonic wave generator oriented to generate ultrasonic waves through the slurry passing through the slurry supply piping and at a frequency which suppresses the tendency of the abrasive particles of the slurry to cluster.

13. The system of claim 12, wherein the sonic wave generator generates a frequency of 10 kHz to 100 kHz.

14. The system of claim 12, wherein the sonic wave generator generates a frequency of 700 kHz to 1000 kHz.

15. The system of claim 12, further comprising recirculation piping disposed between the tank and the slurry supply piping, wherein the slurry within the tank is recirculated through the recirculation piping, and a portion of the circulated slurry is supplied into the slurry supply piping.

16. The system of claim 15, further comprising a pump installed along the slurry supply piping for transferring the slurry from the tank to the processing facility.

* * * * *